US005195544A

United States Patent [19]

Campagna

[11] Patent Number: 5,195,544

[45] Date of Patent: Mar. 23, 1993

[54] NAIL CATCHER CASE

[76] Inventor: Vince Campagna, 830 Westwood St., Coquitlam, Canada, V3L 3C2

[21] Appl. No.: 804,677

[22] Filed: Dec. 11, 1991

[51] Int. Cl.[5] ..... A45D 29/18

[52] U.S. Cl. ..... 132/75.5; 132/73.5; 132/75.3; 30/28

[58] Field of Search ..... 132/73.5, 75, 75.3, 132/75.4, 75.5; 30/28

[56] References Cited

U.S. PATENT DOCUMENTS

| | | | |
|---|---|---|---|
| 2,799,923 | 7/1957 | Senshu | 30/28 |
| 2,829,433 | 4/1958 | Killen | 30/28 |
| 2,887,773 | 5/1959 | Killen | 30/28 |
| 2,970,376 | 2/1961 | Kuo | 30/28 |
| 2,995,820 | 8/1961 | Pocoski | 30/28 |
| 3,013,334 | 12/1961 | Bassett | 30/28 |
| 3,031,753 | 5/1962 | Pocoski | 30/28 |
| 3,031,754 | 5/1962 | Pocoski | 30/28 |
| 3,169,312 | 2/1965 | Fink | 30/28 |
| 3,188,737 | 6/1965 | Chase | 132/75.4 |
| 3,855,698 | 12/1976 | Crosby | 132/73 |
| 3,943,948 | 3/1976 | Sartore | 30/28 |
| 3,986,257 | 10/1976 | Kiura | 30/28 |
| 3,997,966 | 12/1976 | Sertore | 30/28 |
| 4,017,923 | 4/1977 | Schantz | 132/75.4 |
| 4,219,929 | 9/1980 | Min | 30/28 |
| 4,341,015 | 7/1982 | Young | 30/28 |
| 4,380,120 | 4/1983 | Hannon | 30/28 |
| 4,577,754 | 3/1986 | Jones | 30/28 |
| 4,603,430 | 7/1986 | Allen, Jr. | 30/28 |
| 4,614,031 | 9/1986 | Chen | 132/75.5 |
| 4,640,011 | 2/1987 | Gamble | 132/73.5 |
| 4,776,090 | 10/1988 | Grassi | 30/28 |
| 4,934,050 | 6/1990 | Athalye | 132/75 |
| 4,940,136 | 7/1990 | Miller et al. | 132/75.5 |
| 4,984,366 | 1/1991 | Powers | 132/75 |
| 5,072,511 | 12/1991 | Ro | 132/75 |

FOREIGN PATENT DOCUMENTS

| | | | |
|---|---|---|---|
| 1201884 | 3/1986 | Canada | 30/28 |
| 0658577 | 11/1986 | Switzerland | 30/28 |

*Primary Examiner*—Gene Mancene
*Assistant Examiner*—Frank A. LaViola
*Attorney, Agent, or Firm*—Ezra Sutton

[57] ABSTRACT

A hollow nail catcher case is provided herein for use with a nail clipper. The case is preferably constructed of a thin synthetic plastic material. It includes an upper roof, a lower floor and a pair of side walls, all such roof, floor and side walls being of truncated triangular shape and being joined together to provide a hollow truncated hollow pyramid for sliding over the nail clipper. The forward end of the case includes a pair of forwardly-extending, gently-inwardly-curved, flexible walls. These walls also are provided, at their forward ends with sharply inwardly angled termini, such ends also being shaped with vertically-extending, arcuately-shaped, terminal ends, and with upper and lower curved surfaces. These arms are of sufficient longitudinal length fully to enclose the sides of the nail clipper. This enables the case to be universally usable in many different kinds of nail clippers. The gripping arms extend just as far as the nail clipping jaw.

2 Claims, 1 Drawing Sheet

NAIL CATCHER CASE

BACKGROUND OF THE INVENTION (i) Field of the Invention

The present invention relates to an improved nail catcher for attachment to a nail clipper to provide an improved nail clipper, of the type which retains nail clippings during the process of clipping.

(ii) Description of the Prior Art

Finger and toenail clippers having means for collecting nail clippings during the clipping process are known. For example, U.S. Pat. No. 3,855,698 patented Dec. 24, 1974 by K.R. Crosby provided an enclosed nail clip and an enclosing case having a reservoir structure for the clipped nails. The clipping lever was enclosed but had an exposed lever-end accessible for applying finger pressure thereto to close the clipper blades. The casing structure provided a concavely-shaped aperture following the opposing blades providing access to finger ends carrying nails to be clipped. The enclosure was openable for emptying collected nail clippings.

U.S. Pat. No. 3,997,966 patented Dec. 21, 1976 by J. J. A. Sertore provided a nail clipper which had upper and lower handles to facilitate holding the unit and maintaining it in the desired position. It had cutting jaws on three sides to allow nail clipping for different and more convenient angles, and a clipping-receiving receptacle with a removable lid for surrounding the unit and holding the nail clippings.

U.S. Pat. No. 3,169,312 patented Feb. 16, 1965 by C. H. Fink provided a nail guard for mounting on a nail clipper. The nail guard possessed sufficient flexibility so as to enable a slight outward flexing of the side panels which was sufficient to allow the positioning of the lower jaw member between the detents and the bottom panel. Means were provided for pivotally mounting the guard on the nail clipper for movement between a first position where the side panels were positioned on opposite sides of the space between the jaw members so as to enclose this space, and a second position wherein the guard was oriented below the lower jaw so as to open the space between the jaws, and providing a barrier for retaining the cut nails within the enclosed space.

U.S. Pat. No. 2,970,376 patented Feb. 7, 1961 by C. S. Kuo provided a nail clipper device including a pair of normally parallel upper and lower blade members of equal width, a block integrally connecting one end of the blade members together, the opposite ends of the blade members being deformed toward each other and defining cutting edges, and a U-shaped closure member normally closing the sides of the device between the blade members. The closure member was slidably mounted on the device, the closure member together with the blade members and the block normally defining a storage compartment for storing removed nail portions.

U.S. Pat. No. 3,031,754 patented May 1, 1962 by E. J. Pocoski provided a nail clipper including opposed elongated flexible jaw members and a single element associated with the jaw members and consisting of a peripherally continuous rectangular sleeve of resilient material having aligned openings in each of a pair of opposite sides therof. The sleeve enclosed the jaw members near the cutting end thereof. The jaw members had openings aligned with the openings of the sleeve. During a cutting stroke, the sleeve flexed with movement of the jaw members and defined an enclosure for confining nail clippings.

U.S. Pat. No. 3,031,753 patented May 1, 1962 by E. J. Pocoski provided a nail clipper including opposed, elongated flexible jaw members fastened together at one end and having cutter jaws at its other end. Guard means were associated with the cutter jaws, the side walls of the guard means together with the jaw members defining an enclosure for confining clippings during a cutting stroke.

U.S. Pat. No. 2,995,820 patented Aug. 15, 1961 by E. J. Pocoski provided a nail clipper including opposed, elongated flexible jaw members fastened together at one end and having cutter jaws at the other end, and a single guard element secured to the jaw members. The guard element included two opposed side walls defining with the jaw members. An enclosure was provided for confining clippings during a cutting stroke, and flexible tongue was integrally connected to the side walls and extended to the point of connection of the jaw members. The tongue was sufficiently flexible with respect to the cutting jaw ends to permit the guard element to be flexed away from the jaw members by manual pressure to open the enclosure substantially completely.

U.S. Pat. No. 2,799,923 patented Jul. 23, 1957 by H. Senshu provided a nail clipper including top and bottom walls, means resiliently connecting the top and bottom walls, the walls having opposed jaws at the ends thereof, means for moving the jaws toward and away from each other, and a channel-shaped closure member having side walls and a bottom connecting member. Means pivotally connected the channel-shaped member to the sides of the clipper, the channel-shaped member being movable between a position in which the side walls block the side openings between the top and bottom walls, and a position in which the side walls clear the side openings between the top and bottom walls.

Min U.S. Pat. No. 4,219,929 issued Sep. 2, 1980, Young U.S. Pat. No. 4,341,015 issued Jul. 27, 1982 and Hannon U.S. Pat. No. 4,380,120 issued Apr. 19, 1983, all describe and illustrate nail clippers of a conventional type but additionally having receptacles for retaining the clipped-off fingernail or toenail portions. In the Hannon and Min devices, the retainers are formed with retaining walls about the sides of the nail clipper, so that the nail clippings are retained between the plates of the clipper to which the cutting edges of the clippers are attached. In the Min device, the retainer comprises a tubular housing for virtually the entire clipping.

U.S. Pat. No. 3,943,948 patented Mar. 16, 1976 by J. J. A. Sintore provided a case for a nail clipper comprised of a generally-longitudinally-tubular portion in which a nail clipper can be inserted therein. The case conformed to the same general outline of the nail clipper which it housed and was shell-like in appearance. It included internal pressure catches captively to hold the nail clipper in place. It had provision in its top wall to allow for the free movement of the operating handle and provision for a file, placed on a transverse to the longitudinal portion, and also contained a closeable and sealable front lid.

Canadian Patent No. 1,201,884 issued Mar. 18, 1986 to T. C. Webe provided an alleged improvement in a nail clipper including a stationary plate means and a plate means relatively movable with respect thereto, the plate means being joined at one end and the opposite ends having nail cutting edges, and a pivoted lever means associated with the movable plate means for movement thereof. In the improvement, a nail clipping retainer means was secured to and positioned below the stationary plate means. The retainer means had walls defining a chamber for receiving and holding the nail clippings below the stationary plate means, and an aperture behind the nail cutting edges of the stationary plate means communicating with the chamber to receive nail clippings and enable them to pass to the chamber.

SUMMARY OF THE INVENTION (i) Aims of the Invention

All of the above described devices are subject to failings of one type or another, including the fact that nail clippings tend to collect between the plates, and must subsequently be dislodged, for proper operation of the clipper plates, by removal of the retainer of a portion thereof.

Accordingly an object of this invention is to provide an improved nail catcher case for use in combination with a nail clipper to provide a receptacle for collecting and retaining nail clippings.

Another object of this invention is to provide such an improved combination of such nail catcher case and nail clipper.

(ii) Statement of Invention

By this invention, a nail catcher case is provided which is adapted to contain a nail clipper, the nail clipper having forward nail clipping jaws, the nail catcher case being constructed of a thin synthetic plastic material and comprising: an upper roof, a lower floor and a pair of side walls, each of the roof, the floor and the side walls being of truncated triangular shape and being joined together to provide a hollow truncated pyramid for sliding over the nail clipper, the forward end of the nail catcher case including a pair of forwardly-extending, gently-inwardly curved, flexible gripping walls, the walls being of sufficient longitudinal length fully to enclose the sides of the nail clipper when the nail clipper is slipped onto the nail catcher case, thereby to enable the nail catcher case to be universally usable in many different kinds of nail clippers the forward ends of the forwardly-extending, gently-curved, flexible gripping walls also being sharply angled inwardly at their forward termini, and such ends being shaped with vertically-extending, arcuately-shaped, terminal ends, and also with upper and lower curved surfaces; the gripping walls extending only as far as the nail clipping jaws, thereby enabling the provision of a receptacle within the nail clipper for catching nail clippings.

This invention also provides an improved nail clipper combination comprising: a nail clipper comprising upper and lower nail clipping members fastened at one end forming a bifurcated portion, whose opposite end contains spaced-apart jaws formed in opposing relationship to each other, an operating handle rivet being placed through aligned openings located near the jaws, and an operating handle associated with the rivet and controlling the movement of the jaws through the nail clipping members; and a slip-on nail catcher case, enveloping the nail clipper, the nail catcher case being constructed of a thin synthetic plastic material and comprising: an upper roof, a lower floor and a pair of side walls, each of the roof, floor and side walls being of trapezoidal shape and being joined together to provide a hollow truncated pyramid for sliding over the nail clipper, the forward end of the nail catcher case including a pair of forwardly-extending, gently-inwardly-curved, flexible, gripping walls, the walls being of sufficient longitudinal length fully to enclose the sides of the nail clipper when the nail clipper is slipped into the nail catcher case, thereby to enable the nail catcher case to be universally usable in many different kinds of nail clippers the forward ends of the forwardly-extending, gently-curved, flexible gripping walls also being sharply angled inwardly at their forward termini, and such ends being shaped with vertically-extending, arcuately-shaped, terminal ends, and also with upper and lower curved surfaces; the gripping walls extending only as far the nail clipping jaws, thereby enabling the provision of a receptacle within the nail clipper for catching nail clippings.

(iii) Differences over Prior Art

In the nail catcher case, the forward end of the forwardly-extending, gently-inwardly-curved, flexible walls are also angled inwardly at their forward termini and are provided with vertically-extending, arcuately-shaped forward ends, and upper and lower curved surfaces.

In the nail clipper combination, a nail file is included at the rear end of the nail clipper protruding through the open back end of the nail catcher case.

The forward end of the forwardly-extending, gently-inwardly-curved, flexible walls are also angled inwardly at their forward termini and are provided with vertically-extending, arcuately shaped, forward ends, and upper and lower curved surfaces, whereby the forward end will conform to the shape of the end of the nail clipper jaws.

(iv) Differences over Prior Art

The present invention differs in material respects from the catcher case of U.S. Pat. No. 3,943,948. One difference is in the forward end of the case. In the present invention, the forward end of the nail catcher case has no bottom, thereby making the nail catcher case universally adaptable to a wide variety of nail clippers.

Another difference is in the forwardly-extending, gently-inwardly-curved gripping flexible, inwardly-curved, forward walls. Because of the flexible, inwardly-curved, forward walls, the forward end of the nail catcher case can take the shape of the nail clipper itself, regardless of the configuration of the front end of the nail clipper.

A further difference is that, because the rear end of the nail catcher case is open and does not extend the full length of the nail clipper, a nail file will rest atop the case and thus be in full view, as distinct from that of U.S. Pat. No. 3,943,948, where the file is only partly seen through an opening in the top wall.

The present invention also differs from the case for the nail clipper as taught in U.S. Pat. No. 3,943,948. That case included a closeable and slidable front lid. As distinct from the present invention, because of such front lid, the case was not universally usable on many different kinds of nail clippers.

BRIEF DESCRIPTION OF THE DRAWINGS

In the accompanying drawings.

Figure 1:
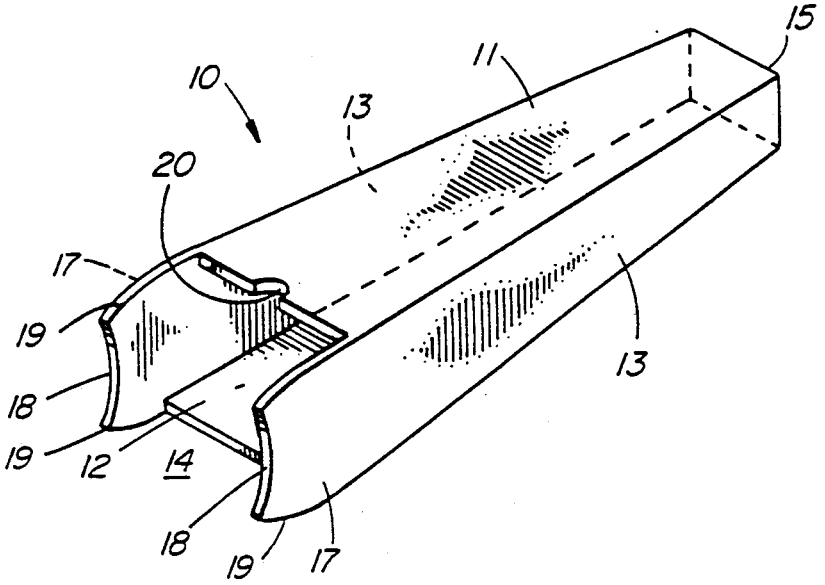
FIG. 1 is a perspective view of the nail catcher case of one embodiment of this invention.

DESCRIPTION OF PREFERRED EMBODIMENTS (i) Description of FIG. 1

As seen in FIG. 1, the nail catcher case 10 includes a top roof 11, a bottom floor 12 and a pair of side walls 13. The floor 12 is somewhat longer than the roof 11. Each of 11, 12 and 13 is in the shape of a trapezoid, so that when the four elements are integrally united, the nail catcher case 10 is in the form of a hollow, truncated pyramid, with an open front end 14 and an open back end 15. The top roof 11 is provided with a forward central notch 20 whose purpose will be described later. The open back end 15 provides an opening for a nail file (not shown), also common to nail clippers, to protrude.

The side walls 13 are each provided with an extending gripping wall 17, each wall being gently curved, and being flexible and/or resilient. The forward end of each wall 17 is provided with an arcuate cut-out 18. The walls 17 also each have gently curved upper and lower corners 19.

The nail catcher case 10 is made of a synthetic plastic material, e.g. polyethylene, nylon, polyvinyl chloride, etc. and is sufficiently thin-walled to enable the forward arms to be flexible and/or resilient.

Figure 2:
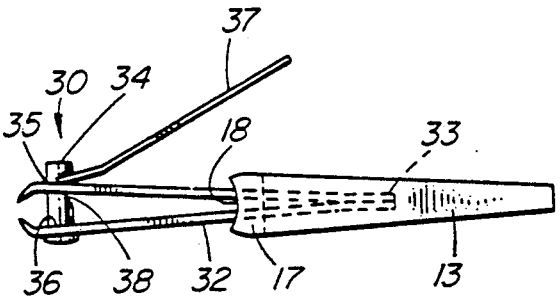
FIG. 2 a side elevational view of the intermediate stage of the combination of the nail catcher case and a nail clipper.
Figure 3:
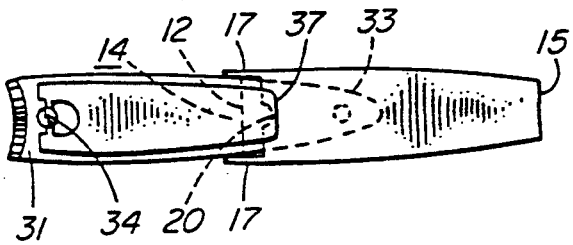
FIG. 3 is a top plan view of the intermediate stage of the combination of the nail catcher case and a nail clipper.

(ii) Description of FIGS. 2 and 3

As seen in FIGS. 2 and 3, the nail catcher case 10 is partially slid over a nail clipper 30. The nail clipper 30 is of conventional design including a pair of sprung upper and lower nail clipper jaws 31, 32 secured together by any conventional means (not shown) at their rear ends 33, and provided with an operating handle rivet 34 placed through aligned openings 35, 36 in the upper and lower jaws 31, 32, the rivet including a cam cut-out 38, within which an operating handle 37 is secured.

Figure 4:
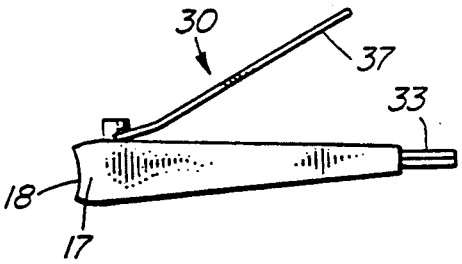
FIG. 4 is a side elevational view of the combination of the nail catcher case and the nail clipper providing another embodiment of this invention.
Figure 5:
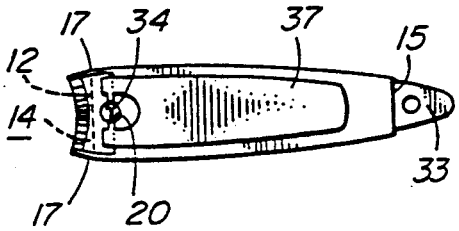
FIG. 5 is a top plan view of the combination of the nail catcher case and the nail clipper providing another embodiment of this invention.

(iii) Description of FIGS. 4 and 5

As seen in FIGS. 4 and 5, the nail catcher case 10 completely encases the nail clipper 30. The rear end 33 of the nail clipper protrudes out through the back end 15 of the nail catcher case 10. If the nail clipper 30 is provided with a nail file, that nail file would also protrude out through the back end 15 of the nail catcher case 10. The notch 20 in the front end of the upper roof 11 of the nail catcher case 10 accommodates the operating handle rivet 34. The forward walls 17 extend only as far as the nail clipping jaws 31, 32. The floor 12 stops short of the nail clipping jaws 31, 32.

OPERATION OF PREFERRED EMBODIMENTS

Thus, the pair of forwardly-extending, gently-inwardly-curved flexible gripping walls 17, enable the nail catcher case to be universally usable in many different kinds of nail clippers, even those whose jaws are provided with a "short angle" face a "no angle" face or a "sharp angle" face. The flexible gripping walls 17 are angled inwardly to allow the walls to move inwardly or outwardly according to the shape of the nail clipper. The tips of the flexible gripping walls 17 also angle in slightly more, to conform to the shape of the nail clipper jaws. Since the back end 15 of the nail catcher case 10 is open, the nail catcher case can fit a nail clipper with or without a nail file. The file can, in fact, rest atop the top roof 11 of the nail catcher case 10. Since the forwardly-extending, gently-inwardly-curved flexible gripping walls 17 extend as far as the nail clipping jaws, a receptacle is provided to catch the nail clippings.

CONCLUSION

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalent of the following claims.

I claim:

1. A slip-on nail catcher case which is adapted to contain a nail clipper having forward nail clipping jaws, said nail catcher case being constructed of a thin synthetic plastic material and comprising: an upper roof, a lower floor and a pair of side walls, each of said roof, floor and side walls being of trapezoidal shape and being joined together to provide a hollow truncated pyramid for sliding over said nail clipper, the forward end of said nail catcher case including a pair of forwardly-extending, gently-inwardly-curved, flexible gripping walls, said walls being of sufficient longitudinal length fully to enclose the sides of said nail clipper when said nail clipper is slipped into said nail catcher case, thereby to enable said nail catcher case to be universally usable in many different kinds of nail clippers, the forward ends of said forwardly-extending, gently-curved, flexible gripping walls also being sharply angled inwardly at their forward termini, and said ends being shaped with vertically-extending, arcuately-shaped, terminal ends, and also with upper and lower curved surfaces; said gripping walls extending only as far as said nail clipping jaws, thereby enabling the provision of a receptacle within said nail clipper for catching nail clippings.

2. An improved nail clipper combination comprising: a nail clipper comprising upper and lower nail clipping members fastened at one end forming a bifurcated portion, whose opposite end contains spaced-apart jaws formed in opposing relationship to each other, an operating handle rivet being placed through aligned openings located near said jaws, and an operating handle associated with said rivet and controlling the movement of said jaws; and a slip-on nail catcher case, enveloping said nail clipper, said nail catcher case being constructed of a thin synthetic plastic material and comprising: an upper roof, a lower floor and a pair of side walls, each of said roof, floor and side walls being of trapezoidal shape and being joined together to provide a hollow truncated pyramid for sliding over said nail clipper, the forward end of said nail catcher case including a pair of forwardly-extending, gently-inwardly-curved, flexible gripping walls, said walls being of sufficient longitudinal length fully to enclose the sides of said nail clipper when said nail clipper is slipped into said nail catcher case, thereby to enable said nail catcher case to be universally usable in many different kinds of nail clippers, the forward ends of said forwardly-extending, gently-curved, flexible gripping walls also being sharply angled inwardly at their forward termini, and said ends being shaped with vertically-extending, arcuately-shaped, terminal ends, and also with upper and lower curved surfaces; said gripping walls extending only as far as said nail clipping jaws, thereby enabling the provision of a receptacle within said nail clipper for catching nail clippings.

* * * * *